US008846588B2

(12) United States Patent
Crossen et al.

(10) Patent No.: US 8,846,588 B2
(45) Date of Patent: Sep. 30, 2014

(54) LOW VISCOSITY FUNCTIONAL FLUIDS

(75) Inventors: Pearl Crossen, Redear (GB); Jin Zhao, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 43 days.

(21) Appl. No.: 13/698,706

(22) PCT Filed: Jun. 22, 2011

(86) PCT No.: PCT/US2011/041328

§ 371 (c)(1), (2), (4) Date: Nov. 19, 2012

(87) PCT Pub. No.: WO2012/003117

PCT Pub. Date: Jan. 5, 2012

(65) Prior Publication Data

US 2013/0090274 A1 Apr. 11, 2013

Related U.S. Application Data

(60) Provisional application No. 61/360,710, filed on Jul. 1, 2010.

(51) Int. Cl.

| | |
|---|---|
| ***C10M 129/16*** | (2006.01) |
| ***C10M 129/88*** | (2006.01) |
| ***C10M 129/95*** | (2006.01) |
| ***C10M 169/04*** | (2006.01) |
| ***C10M 129/70*** | (2006.01) |

(52) U.S. Cl.

CPC ..... *C10M 129/70* (2013.01); *C10M 169/04* (2013.01); *C10M 2227/0615* (2013.01); *C10M 2207/0406* (2013.01); *C10M 2207/026* (2013.01); *C10M 2215/042* (2013.01); *C10M 2215/22* (2013.01); *C10M 2215/221* (2013.01); *C10N 2240/08* (2013.01); *C01M 111/04* (2013.01); *C10M 2201/082* (2013.01); *C10N 2230/36* (2013.01); *C10M 2209/1045* (2013.01); *C10N 2230/02* (2013.01)

USPC ..... 508/199; 508/176; 508/186; 508/185

(58) Field of Classification Search

USPC ..... 585/1, 3; 508/176, 185, 186, 198, 199

See application file for complete search history.

(56) References Cited

U.S. PATENT DOCUMENTS

| | | | | |
|---|---|---|---|---|
| 3,925,223 | A | 12/1975 | Coffman et al. | |
| 4,116,846 | A | 9/1978 | Sato et al. | |
| 4,219,434 | A | 8/1980 | Ellis | |
| 6,558,569 | B1 | 5/2003 | Shannon et al. | |
| 7,951,757 | B2 * | 5/2011 | Carpenter et al. | 508/199 |
| 2007/0027039 | A1 * | 2/2007 | Carpenter et al. | 508/354 |
| 2009/0099048 | A1 * | 4/2009 | Zhao et al. | 508/185 |

FOREIGN PATENT DOCUMENTS

WO 0238711 A1 5/2002

OTHER PUBLICATIONS

Makromer Co., Ltd, RU 2087528, Derwent Abstract, Jun. 22, 1995, 98-177606/16.

* cited by examiner

*Primary Examiner* — Pamela H Weiss

(57) ABSTRACT

Low viscosity functional fluids are described which comprises methoxy polyethylene glycol. The fluids are particularly well-suited for use as DOT 4 brake fluids and provide high ERBP, WERBP, low kinematic viscosity and low SBR volume % increase.

19 Claims, No Drawings

LOW VISCOSITY FUNCTIONAL FLUIDS

CROSS REFERENCE STATEMENT

This application claims the benefit of U.S. Provisional Application No. 61/360,710, filed Jul. 1, 2010, which is incorporated herein by reference.

TECHNICAL FIELD

This disclosure relates to low viscosity functional fluids which are useful in a variety of applications, and in particular, as brake fluids.

BACKGROUND

Newly developed equipment such as electronic or automated anti-lock braking systems, stability control systems and regenerative braking systems have created a need for high performance hydraulic fluids (e.g., brake fluids) having appropriate physical and performance properties. In particular, there is a strong demand for high performance brake fluids having high equilibrium reflux boiling point (ERBP) and high Wet ERBP (WERBP) and low kinematic viscosity at −40 C, while maintaining or improving elastomer (Styrene Butadiene Rubber (SBR) cup) compatibility.

U.S. Pat. No. 6,558,569B1 describes brake fluids made using borate esters, alkoxy glycols and additives. U.S. Pat. No. 3,925,223 describes hydraulic fluids having improved wet equilibrium boiling points and improved rubber swell per FMVSS 116 using borate esters.

From the above, it would be desirable for a performance (e.g. brake) fluid that solves one or more of the deficiencies of the prior art such as described above and provide a fluid composition exhibiting desired properties in terms of high ERBP and high Wet WERBP) and low kinematic viscosity at −40 C, and low SBR cup volume swell.

SUMMARY

A functional fluid composition is provided which comprises a functional fluid composition comprising (i) an alkoxy glycol mixture in an amount of about 38% to 47% by weight of the functional fluid composition, where the alkoxy glycol mixture is comprised of alkoxy glycols having the formula:

EQUATION I

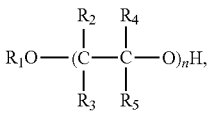

with repeat unit:

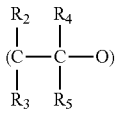

wherein each of R1, R2, R3, R4, R5 is either hydrogen (H) or an alkyl group containing 1 to 8 or more carbon atoms or mixtures thereof, wherein said mixture has a first alkoxy glycol component in an amount of about 36% to about 73% by weight of said mixture where n=3, a second alkoxy glycol component from 17% to about 43% by weight of said mixture where n=4, and a third alkoxy glycol component in an amount from about 2% to about 10% by weight of said alkoxy glycol mixture where n is greater than or equal to 5 and (ii) a glycol borate ester in an amount of about 53% to 62% by weight of the functional fluid composition.

Surprisingly and unexpectedly, the inventors of the present invention have found particular concentrations of particular alkoxy glycols is important in meeting the SBR volume swell requirement while achieving other criteria like ERBP, wet ERBP and kinematic viscosity. Thus, by virtue of having the desired levels of a mixture of differing alkoxy glycols and particular levels of glycol borate esters in the composition, the functional fluid composition of the invention exhibits high ERBP, high WERBP, low kinematic viscosity at −40° C. while satisfying the SBR compatibility criteria of % volume swell at 120° C. for 70 hours (hr).

DETAILED DESCRIPTION

The alkoxy glycol mixture preferably is comprised of alkoxy glycol components where $R_2$, $R_3$, $R_4$, and $R_5$ are each H. That is, the alkoxy glycol mixture is comprised of differing alkoxy polyethylene glycols.

In a particular embodiment, the first alkoxy glycol is methoxy triethylene glycol (MTG). In another particular embodiment, the second alkoxy glycol is methoxy tetraethylene glycol. In a third particular embodiment, the third alkoxy glycol is a methoxy polyethylene glycol where "n" is greater than or equal to 5. In other embodiments, any combinations of the aforementioned may be combined individually with one other or combined all together. For example, the alkoxy glycol mixture is each of the alkoxy components corresponds to the aforementioned methoxy (tri, tetra or poly) ethylene glycols.

The alkoxy glycol mixture is in an amount of about 38% to 47% by weight of the functional fluid composition. Preferably, the alkoxy glycol mixture is in an amount of about 40 to 45% by weight of the functional fluid composition.

In another embodiment, the alkoxy glycol mixture may comprise up to 9% of butoxy triethylene glycol (BTG), but BTG is not necessary and is preferably absent from the functional fluid composition.

The functional fluid composition may even further comprise up to 3 weight % of one or more corrosion inhibitors, up to 1 weight % of one or more anti-oxidants, and a suitable amount of an antifoaming agent, pH stabilizer and/or chelating agent.

In addition to the alkoxy glycol mixture, the fluid composition may contain small amounts of alkoxy glycols where "n" is 2 or 1. Generally, the amount of these alkoxy glycols is less than about 2% by weight of the functional fluid composition. If present, these too are preferably methoxy di-ethylene or methoxy ethylene glycol.

The compositions of present invention may also further comprise one or more other glycols in small quantities. Without limitation, examples of such useful other glycols include methoxy triglycol, methoxy diglycol, methoxy tetraglycol, methoxy polyglycol, ethoxy triglycol, ethoxy diglycol, ethoxy tetraglycol, propoxy triglycol, butoxy triglycol (e.g., triethylene glycol monobutyl ether), butoxy diglycol (e.g., diethylene glycol monobutyl ether), butoxy tetraglycol, butoxy polyglycol (e.g., mixtures of butoxy triglycol, butoxy tetraglycol, and other glycols in which $R_1$ is an alkyl having 4 carbon atoms and n is 5 or greater), butoxy pentoxy diglycol, pentoxy triglycol, 2-ethylhexyl diglycol, diethylene glycol monopropyl ether, triethylene glycol monopropyl ether, dipropylene glycol monomethyl ether, dipropylene glycol monopropyl ether, tripropylene glycol monopropyl ether, dipropylene glycol monobutyl ether, dipropylene glycol monomethyl ether, tripropylene glycol monoethyl ether, tripropylene glycol monopropyl ether, tripropylene glycol monobutyl ether, polypropylene glycol monopropyl ether, polypropylene glycol monobutyl ether, polybutylene glycol monopropyl ether, polybutylene glycol monobutyl ether and any mixture thereof.

The functional fluid compositions of present invention are comprised of a glycol borate ester. Examples of glycol borate esters include alkoxy glycol borate ester components such as methoxy triethylene glycol borate ester, ethoxy triethylene glycol borate ester, butoxy triethylene glycol borate ester and mixtures thereof disclosed in U.S. Pat. No. 6,558,569, hereby incorporated by reference. In certain embodiment of the invention, MTG borate ester of the reference formulation is replaced with M240 borate. The M240 borate ester is methoxy triethylene glycol borate ester with high boron content (~2% boron).

As mentioned above, the composition may also include an additive package which contains at least one fatty acid, at least one phosphate ester, one or more corrosion inhibitors, and one or more of the following: an antifoaming agent, a pH stabilizer, a chelating agent, and an antioxidant. The corrosion inhibitors in the additive package preferably include compounds that inhibit the corrosion of tinned iron, steel, aluminum, cast iron, brass, and copper, each of which has a corrosion specification set forth in SAE J1703, SAE J1704 and FMVSS 116. However, in an especially preferred embodiment, the corrosion inhibitors also include one or more compounds that inhibit the corrosion of zinc.

The additive package is preferably present in an amount that is at least about 0.1 percent by weight of the fluid composition, more preferably at least about 0.2 percent by weight of the fluid composition, and most preferably at least about 0.3 percent by weight of the fluid composition. The additive package is preferably present in an amount that is no greater than about 10 percent by weight of the fluid composition, more preferably no greater than about 6.0 percent by weight of the fluid composition, and most preferably no greater than about 4.0 percent by weight of the fluid composition.

The fatty acids in the additive package preferably include one or more aliphatic carboxylic acids having at least 2, preferably at least 5, more preferably at least 10, and even more preferably at least 15 carbon atoms. The aliphatic carboxylic acids generally have no more than 35, preferably no more than 30, and more preferably no more than 25 carbon atoms Straight chain, monofunctional fatty acids are preferred, and straight chain, unsaturated, monofunctional fatty acids are more preferred. Monounsaturated fatty acids are especially preferred. Suitable fatty acids include without limitation, oleic acid, palmitic acid, stearic acid, myristic acid, palmitoleic acid, elaidic acid, and linoleic acid. The fatty acids in the additive package are generally present in an amount that is at least about 0.01 percent, preferably at least about 0.04 percent, and more preferably at least about 0.08 percent by weight of the fluid composition. The fatty acids are generally present in an amount that is no greater than about 0.4 percent, more preferably no greater than about 0.2 percent, and most preferably no greater than about 0.15 percent by weight of the fluid composition.

One or more of the additives in the additive package will generally be a phosphate, and more specifically, a phosphate ester. The phosphate ester is generally a mono, di- or tri-ester of an alcohol and phosphoric acid ($H_3PO_4$). The alcohol preferably has the following formula:

$$R_1—R_2—OH$$

wherein $R_1$ is a substituted or unsubstituted alkyl, alkenyl, or aryl group having at least 2, more preferably at least 3, even more preferably at least 4, and still more preferably at least 6 carbon atoms. $R_1$ preferably has no more than 30, more preferably no more than 28, even more preferably no more than 26, and still more preferably no more then 24 carbon atoms. $R_2$ is preferably an alkyl or alkoxy group having from two to six carbon atoms. In one exemplary embodiment, $R_2$ is an ethoxy group (—O—$CH_2$—$CH_2$—), Suitable phosphate esters include without limitation, RHODOFAC® RM-510 (Rhodia), a dinonylphenol, ethoxylated, phosphate ester, LUBRHOPHOS® LP-700 (Rhodia), a phosphate ester of ethoxylated phenol, LUBRHOPHOS® LB-400 (Rhodia), an ethoxylated phosphate ester of oleic alcohol, LUBRHOPHOS® LK-500 (Rhodia), a phosphate ester of ethoxylated hexanol, and tricresyl phosphate, a phosphate triester of cresol.

The phosphate ester is preferably present in an amount that is at least about 0.05 percent, more preferably at least about 0.1 percent, and even more preferably at least about 0.15 percent by weight of the functional fluid. The phosphate ester is preferably present in an amount that is no greater than about 0.4 percent, more preferably no greater than about 0.3 percent, and even more preferably no greater than about 0.25 percent by weight of the functional fluid. Without wishing to be bound by any theory, and as explained further below, it is believed that the combination of the phosphate ester and the fatty acid in the functional fluid additive package produces a synergistic effect that unexpectedly improves the lubricity of the functional fluid.

The corrosion inhibitors preferably include at least one heterocyclic nitrogen-containing compound, for example, triazoles such as benzotriazole, tolytriazole, 1,2,4 triazole, and mixtures thereof. The triazole compounds are preferably present in an amount that is at least about 0.01 percent, more preferably at least about 0.05 percent, and most preferably at least about 0.09 percent by weight of the total fluid weight. The triazole compounds are preferably present in an amount that is no greater than about 0.4 percent, more preferably no greater than about 0.3 percent, and most preferably no greater than about 0.20 percent by weight of the total fluid composition. Without wishing to be bound by any theory, triazole compounds such as benzotriazole, tolytriazole, and 1,2,4 triazole are believed to be particularly effective for inhibiting copper corrosion.

The corrosion inhibitors also preferably include amine compounds other than triazoles, including alkyl amines (e.g., di n-butylamine and di n-amylamine), cyclohexylamine, piperazines (e.g., hydroxylethyl piperazine), and salts thereof. Non-triazole amine compounds which are particularly useful as corrosion inhibitors in the functional fluid compositions of the present disclosure include the alkanol amines, preferably those containing one to three alkanol groups with each alkanol group containing from one to six carbon atoms. Examples of useful alkanol amines include mono-, di- and trimethanolamine, mono-, di- and triethanolamine, mono-, di- and tripropanolamine and mono-, di- and triisopropanolamine. Preferred alkanol amines include butyldiethanol amine and diisopropanolamine ("dipa"). Without wishing to be bound by any theory, the alkanolamines are believed to be effective for inhibiting the corrosion of ferrous compounds (e.g., iron, steel) and also act as a buffer.

The non-triazole amine compounds are preferably present in an amount that is at least about 0.1 percent, more preferably at least about 0.5 percent, and even more preferably at least about 0.8 percent by weight of the fluid composition. The non-triazole amine compounds are preferably present in an amount that is no greater than about 3 percent, more preferably no greater than about 2.0 percent, and most preferably no greater than about 1.5 percent by weight of the total fluid composition.

The corrosion inhibitors may include one or more alkenyl succinic anhydrides. Preferred alkenyl succinic anhydrides include derivatives of maleic anhydride. Dodecenyl succinic anhydride is especially preferred. When included in the functional fluid, the alkenyl succinic anhydrides are preferably present in an amount that is at least about 0.1 percent, more preferably at least about 0.12 percent, and most preferably at least about 0.14 percent by weight of the functional fluid composition. The alkenyl succinic anhydrides are preferably present in an amount that is no greater than about 0.5 percent, more preferably no greater than about 0.3 percent, and most preferably no greater than about 0.2 percent by weight of the functional fluid composition.

In certain embodiments, the corrosion inhibitors also include one or more inorganic nitrates, preferably sodium nitrate or potassium nitrate. The inorganic nitrates are preferably present in an amount that is at least about 0.01 percent, more preferably at least about 0.015 percent and most preferably at least about 0.02 percent by weight of the fluid composition. The inorganic nitrates are preferably present in an amount that is no greater than about 0.06 percent, more preferably no greater than about 0.05 percent, and most preferably no greater than about 0.04 percent by weight of the fluid composition. Without wishing to be bound by any theory, the inorganic nitrates are believed to be effective at inhibiting the corrosion of aluminum.

The corrosion inhibitors may include one or more inorganic borates such as Sodium Tetraborate, commonly known as Borax. The inorganic borates are preferably provided as solid hydrates. An especially preferred inorganic borate is sodium tetraborate pentahydrate $Na_2B_4O_7.5H_20$, also known as Borax 5 Mol. Another exemplary inorganic borate is sodium tetraborate decahydrate ($Na_2B_4O_7.10H_20$). When present, the inorganic borate is preferably provided in an amount that is at least about 0.03 percent, more preferably at least about 0.05 percent, and most preferably at least about 0.07 percent by weight of the fluid composition. The inorganic borate is preferably provided in an amount that is no greater than about 0.1 percent, more preferably greater than about 0.09 percent, and most preferably no greater than about 0.08 percent by weight of the fluid composition. Without wishing to be bound by any theory, the inorganic borates are believed to be effective at inhibiting ferrous corrosion (e.g., iron and steel).

The corrosion inhibitors may also optionally include one or more silicone compounds such as silicate esters. Preferred silicate esters include polymers of dialkoxysiloxanes, including without limitation poly(diethoxysiloxane) (e.g., PSI-021). The silicone corrosion inhibitor is preferably provided in an amount that is at least about 0.001 percent, more preferably at least about 0.003 percent, and most preferably at least about 0.004 percent by weight of the fluid composition. The silicone corrosion inhibitor is preferably provided in an amount that is no greater than about 0.008 percent, more preferably no greater than about 0.007 percent, and most preferably no greater than about 0.006 percent by weight of the fluid composition. Without wishing to be bound by any theory, the silicone corrosion inhibitors are believed to inhibit the corrosion of brass and aluminum.

In addition to the foregoing corrosion inhibitors, the functional fluid additive package may also include other additive compounds such as antifoaming agents, pH stabilizers, chelating agents, antioxidants, and the like. Preferred antifoaming agents include poly(dimethylsiloxane) and silicone-based compounds such as SAG 100 Antifoam, a product of GE Advanced Materials. If present, the antifoaming agent is preferably provided in an amount that is no greater than about 0.00020 percent and more preferably no greater than about 0.00015 percent by weight of the fluid composition. The antifoaming agent is preferably present in an amount that is at least about 0.00001 percent and more preferably at least about 0.00005 percent by weight of the fluid composition.

Suitable antioxidants include phenolic compounds and quinoline compounds. Exemplary phenolic antioxidants include BHT (butylated hydroxytoluene); 2,6-di-tert-butyl-4-methyl phenol (which is supplied by Great Lakes Chemical Corporation under the tradename LOWINOX624) 2,6-di-tert-butyl-p-cresol, 2,6-di-tertiary-butyl-4-sec-butylphenol (which is supplied by the Schenectady International Inc., Schenectady, N.Y. under the tradename ISONOX 132), and bisphenol A. Exemplary quinoline antioxidants include Agerite® Resin D, a polymerized trimethyl dihydroquinoline compound supplied by the R.T. Vanderbilt Company. If antioxidants are included in the additive package, they are preferably provided in an amount that is at least about 0.1 percent, more preferably at least about 0.2 percent, and most preferably at least about 0.25 percent by weight of the fluid composition. The antioxidants are provided in an amount that is preferably no greater than about 1.0 percent, more preferably no greater than about 0.8 percent, and most preferably no greater than about 0.4 percent by weight of the fluid composition.

Suitable chelating agents include trioctylphosphine oxide, tributylphosphate, dibuty butylphosphate, DEHPA (Di(2-ethylhexyl)phosphoric acid) and propanediamine/xylene compositions such as DuPont Metal Deactivator (N,N' Disalicylidene-1,2-propanediamene and xylene). When used, the chelating agents are preferably present in an amount that is at least about 0.01 percent, more preferably at least about 0.05 percent, and most preferably at least about 0.08 percent by weight. The chelating agents are preferably present in an amount that is no greater than about 0.2 percent, most preferably no greater than about 0.15 percent, and most preferably no greater than about 0.13 percent by weight of the fluid composition.

In certain preferred embodiments, the fluid compositions maintain a wet equilibrium reflux boiling point (WERBP) of no less than about 155° C., a dry equilibrium reflux boiling point (ERBP) of no less than about 230° C. The functional fluids preferably have a kinematic viscosity at −40° C. of no greater than about 1800 cSt.

In the present disclosure, the inventors unexpectedly found that the high ERBP, high WERBP and low kinematic viscosity at −40° C. can be achieved by employing compositions of the present disclosure, while attaining low SBR Cup volume increase (less than 10%).

The functional fluids described herein may generally used as DOT4 brake fluids passing the standards set by FMVSS 116, SAE 1704 and ISO 4925.

EXAMPLES

Comparative Example

Composition of the Comparison Example:

TABLE 3

| Component | Wt. % |
|---|---|
| Methoxy triethylene glycol (MTG) | 28.3 |
| MTG Borate | 55.2 |
| Butoxy triethylene glycol (BTG) | 14.5 |
| Methoxy polyglcyol (MPG) mixture | 0 |
| Diisopropanolamine | 1.5 |
| 1,2,4-triazole | 0.1 |
| Tolytriazole | 0.1 |
| Potassium Nitrate | 0.03 |
| Isonox 132 | 0.3 |

ERBP, WERBP and viscosity at −40° C. tests are carried out according to FMVSS 116. SBR testing for % volume increase is carried out as specified by SAE J1704 except that the test was carried out at 125 ° C. for 72 hr instead of 120° C. for 70 hr.

The Results are Set Forth Below in Table

| Specification | Requirement | Reference Composition |
|---|---|---|
| ERBP (° C.) (minimum) | 230 | 267 |
| WERBP (° C.) (minimum) | 155 | 174 |
| −40° C. kinematic viscosity (cSt) (maximum) | 1800 | 620 |
| Elastomer Compatability with SBR cups (72 hr at 125° C.) | | |
| Change of volume (%) (maximum) | 0-10% | 11.6 |

Example 1

The composition of Example 1:

TABLE 4

| Component | Wt. % |
|---|---|
| Methoxy triethylene glycol (MTG) | 23 |
| MTG Borate | 58 |
| Butoxy triethylene glycol (BTG) | 0 |
| Methoxy polyglcyol (MPG) # | 17 |
| Diisopropanolamine | 1.5 |
| 1,2,4-triazole | 0.1 |
| Tolytriazole | 0.1 |
| Potassium Nitrate | 0.03 |
| Isonox 132 | 0.3 |

"Methoxy polyglycol"("MPG") refers to a mixture of methoxy triethylene glycol (10 wt. percent of the MPG) methoxy tetraethylene glycol (78.4 wt. percent of the MPG), and methoxy poly glycols with five or more repeating ethylene glycol units (10.9 wt. percent of the MPG).

ERBP, WERBP and viscosity at −40° C. tests are carried out according to FMVSS 116. SBR testing for % volume increase is carried out as specified by SAE J1704 except that the test was carried out at 125° C. for 72 hr instead of 120° C. for 70 hr.

The Results are Set Forth Below in Table

| Specification | Requirement | Reference Composition |
|---|---|---|
| ERBP (° C.) (minimum) | 230 | 269 |
| WERBP (° C.) (minimum) | 155 | 178 |
| −40° C. kinematic viscosity (cSt) (maximum) | 1800 | 744 |
| Elastomer Compatability with SBR cups (72 hr at 125° C.) | | |
| Change of volume (%) (maximum) | 0-10% | 8.55 |

Example 2

| Component | Wt. % |
|---|---|
| Methoxy triethylene glycol (MTG) | 22 |
| MTG Borate | 57 |
| Butoxy triethylene glycol (BTG) | 2 |
| MPG | 17 |
| Diisopropanolamine | 1.5 |
| 1,2,4-triazole | 0.1 |
| Tolytriazole | 0.1 |
| Potassium Nitrate | 0.03 |
| Isonox 132 | 0.3 |

ERBP, WERBP and viscosity at −40° C. tests are carried out according to FMVSS 116. SBR testing for % volume increase is carried out as specified by SAE J1704 except that the test was carried out at 125° C. for 72 hr instead of 120° C. for 70 hr.

The Results are Set Forth Below in Table

| Specification | Requirement | Reference Composition |
|---|---|---|
| ERBP (° C.) (minimum) | 230 | 270 |
| WERBP (° C.) (minimum) | 155 | 176 |
| −40° C. kinematic viscosity (cSt) (maximum) | 1800 | 734 |
| Elastomer Compatability with SBR cups (72 hr at 125° C.) | | |
| Change of volume (%) (maximum) | 0-10% | 9.11 |

Functional fluids of the present disclosure also passed other standard specifications, including but not limited to, lubricity, stability, corrosion, pH, fluidity and appearance, water tolerance, compatibility, resistance to oxidation, effect on rubber, and evaporation.

Functional fluids of the present disclosure are well suited for use as a hydraulic fluid for numerous mechanical systems (e.g., hydraulic lifts, cranes, forklifts, bulldozers, hydraulic jacks, brake systems, combinations thereof, or the like). The high lubricity as well as the ERBP, WERBP, and low temperature viscosity of these fluid compositions make them well-suited for brake systems in transportation vehicles (e.g., fixed and rotary wing aircraft, trains, automobiles in classes 1 to 8, or the like). These braking systems include anti-lock braking systems (ABS), stability control systems, or combinations thereof.

The explanations and illustrations presented herein are intended to acquaint others skilled in the art with the disclosure, its principles, and its practical application. Those skilled in the art may adapt and apply the disclosure in its numerous forms, as may be best suited to the requirements of a particular use. Accordingly, the specific embodiments of the present disclosure as set forth are not intended as being exhaustive or limiting. The scope of the disclosure should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

What is claimed is:

1. A functional fluid composition comprising (i) an alkoxy glycol mixture in an amount of 38% to 47% by weight of the functional fluid composition, where the alkoxy glycol mixture is comprised alkoxy glycols having the formula:

EQUATION I

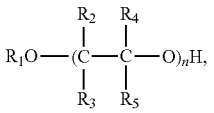

wherein each of R1, R2, R3, R4, R5 is either hydrogen (H) or an alkyl group containing 1 to 8 or more carbon atoms or mixtures thereof, wherein said mixture has a first alkoxy glycol component in an amount of 36% to 73% by weight of said alkoxy glycol mixture where n=3, a second alkoxy glycol component from 17% to 43% by weight of said alkoxy glycol mixture where n=4, and a third alkoxy glycol component in an amount from 2% to 10% by weight of said alkoxy glycol mixture where n is greater than or equal to 5 and (ii) a glycol borate ester in an amount of 53% to 62% by weight of the functional fluid composition.

2. The functional fluid composition of claim 1, wherein the first alkoxy glycol component is methoxy triethylene glycol.

3. The functional fluid composition of claim 2, wherein the second alkoxy glycol component is methoxy tetra ethylene glycol.

4. The functional fluid composition of claim 3, wherein the third alkoxy glycol component is a methoxy polyethylene glycol.

5. A functional fluid composition of claim 4, further comprising greater than 0 to 3 weight % of one or more corrosion inhibitors.

6. A functional fluid composition of claim 1, wherein one or more corrosion inhibitors are selected from heterocyclic nitrogen-containing compounds, amine compounds including alkanol amines, alkenyl succinic anhydrides, inorganic nitrates, inorganic borates and silicate esters.

7. A functional fluid composition of claim 1, further comprising greater than 0 to 1 weight % of one or more anti-oxidants.

8. A functional fluid composition of claim 7, wherein one or more anti-oxidants are phenolic compounds, quinoline compounds or mixtures thereof.

9. A functional fluid composition in accordance with claim 1, further comprising an antifoaming agent, pH stabilizer, chelating agent or mixture thereof.

10. A functional fluid composition in accordance with claim 1, wherein the glycol borate ester is methoxy triethylene glycol borate ester.

11. A functional fluid composition in accordance with claim 10, wherein the boron content of methoxy triethylene glycol borate ester is 2%.

12. A functional fluid composition in accordance with claim 1, further comprising methoxy diethylene glycol.

13. A functional fluid composition in accordance with claim 1, wherein the fluid composition has an equilibrium reflux boiling point of at least 230° C.

14. A functional fluid composition in accordance with claim 1, wherein the fluid composition has a wet equilibrium reflux boiling point of at least 155° C.

15. A functional fluid composition in accordance with claim 1, wherein the fluid composition has a kinematic viscosity of not more than 1800 cST at −40° C.

16. A functional fluid composition in accordance with claim 1, wherein the fluid composition exhibits SBR Cup volume increase of not more than 10 percent tested for 70 hours at 120° C.

17. The functional fluid composition of claim 1, wherein the glycol borate ester is an alkoxy glycol borate ester.

18. A functional fluid composition comprising (i) an alkoxy glycol mixture in an amount of 38% to 47% by weight of the functional fluid composition, where the alkoxy glycol mixture is comprised of alkoxy glycols having the formula:

EQUATION I

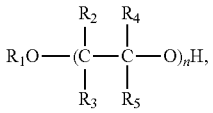

wherein each of R1, R2, R3, R4, R5 is either hydrogen (H) or an alkyl group containing 1 to 8 or more carbon atoms or mixtures thereof, wherein the alkoxy glycol mixture includes from 36% to 73% by weight of methoxy triethylene glycol based on the total weight of the alkoxy glycol mixture; from 17% to 43% methoxy tetra ethylene glycol, based on the total weight of the alkoxy glycol mixture; and from 2% to 10% methoxy polyethylene glycol, based on the total weight of the alkoxy glycol mixture, wherein the methoxy polyethylene glycol has n that is greater than or equal to 5;

(ii) a glycol borate ester in an amount of 53% to 62% by weight of the functional fluid composition;

(iii) greater than 0 to 3 weight % of one or more corrosion inhibitors, based on the total weight of the functional fluid composition; and (iv) greater than 0 to 1 weight % of one or more antioxidants, based on the total weight of the functional fluid composition;

wherein the fluid composition has an equilibrium reflux boiling point of at least 230° C., a wet equilibrium reflux boiling point of at least 155° C., and a kinematic viscosity of not more than 1800 cST at −40° C.

19. The functional fluid composition of claim 18, wherein the glycol borate ester is an alkoxy glycol borate ester.

* * * * *